US010722420B1

(12) United States Patent
Miller

(10) Patent No.: US 10,722,420 B1
(45) Date of Patent: Jul. 28, 2020

(54) LIGHT-WEIGHT GAIT TRAINER

(71) Applicant: AREA Health Design, Denver, CO (US)

(72) Inventor: Ethan Gilbert Miller, Parker, CO (US)

(73) Assignee: AREA Health Design, Denver, CO (US)

( * ) Notice: Subject to any disclaimer, the term of this patent is extended or adjusted under 35 U.S.C. 154(b) by 0 days.

(21) Appl. No.: 16/290,183

(22) Filed: Mar. 1, 2019

(51) Int. Cl.
*A61H 3/04* (2006.01)

(52) U.S. Cl.
CPC ..... *A61H 3/04* (2013.01); *A61H 2201/0157* (2013.01); *A61H 2203/0406* (2013.01)

(58) Field of Classification Search
CPC ..... A61H 3/04; A61H 2203/0406; A47D 3/04
See application file for complete search history.

(56) References Cited

U.S. PATENT DOCUMENTS 3,532,356 A * 10/1970 Lillibridge ..... A47D 13/04 280/87.051
3,840,034 A * 10/1974 Smith ..... A61H 3/00 135/67
4,510,956 A 4/1985 King
4,569,532 A * 2/1986 Mirkarimi ..... B62B 7/00 280/32.5
4,700,730 A * 10/1987 Samuelson ..... A61H 3/04 135/67
5,476,432 A * 12/1995 Dickens ..... A61H 3/04 135/67
6,428,033 B1 8/2002 Harrison et al.
7,229,092 B1 * 6/2007 Parker ..... A61H 3/04 280/47.11
7,588,043 B1 9/2009 Bais
8,740,242 B2 * 6/2014 Slomp ..... B26B 3/02 135/67
9,657,770 B2 * 5/2017 Moller ..... A61H 3/04
2002/0038942 A1 * 4/2002 Gilles ..... A47D 13/04 280/87.051
2003/0148858 A1 * 8/2003 Jones ..... A47D 13/04 482/66
2004/0079405 A1 4/2004 Sanders et al.
2009/0278325 A1 * 11/2009 Geels ..... A61H 3/04 280/5.28
2011/0067739 A1 3/2011 Ma

FOREIGN PATENT DOCUMENTS

GB 2124507 A * 2/1984 ..... A47D 13/04

* cited by examiner

*Primary Examiner* — Noah Chandler Hawk

(57) ABSTRACT

Embodiments include a gait trainer device with multiple components and capable of being assembled by a user. The gait trainer may include a first side frame disposed diagonally relative to the ground, a second side frame parallel to the first side frame, a leaning cushion disposed at the end of the first side frame and the end of the second side frame and configured to support a user's weight, and a lower c-shaped frame extending perpendicularly from both the first joint and the second joint. These components among others may be assembled to create a gait trainer for use in assisting and increasing mobility.

16 Claims, 5 Drawing Sheets

LIGHT-WEIGHT GAIT TRAINER

TECHNICAL FIELD

Embodiments of the present disclosure relate to an apparatus for improving mobility for children with injuries or developmental disabilities. More particularly, the present disclosure relates to an apparatus for gait training that improves posture and facilitates muscle development.

BACKGROUND

Children with movement disorders, such as cerebral palsy, have difficulty walking due to stiff or weak muscles. Due to their lack of mobility, many children cannot easily move from place to place and require external support devices or parental assistance. One such external support device, a gait trainer, typically includes a metal or plastic frame attached to wheels so that a child can travel from place to place without parental assistance, with minimal risk of falling or injuring themselves.

Typical gait trainers include heavy materials and complex designs in order to provide a child with adequate support and to minimize equipment malfunction. However, these design choices often result in overly-complicated, expensive apparatuses that sacrifice mobility for safety. Because these typical gait trainers are large and heavy, it can be difficult for a child to move upstairs, turn corners, or travel along narrow hallways. When transporting typical gait trainers to locations outside of the home, vehicles must be specifically outfitted with equipment to secure and fit large, heavy apparatuses. Additionally, these heavy gait trainers can be prohibitively expensive and can result in an enormous financial burden. There is, therefore, a need for a light-weight, inexpensive, and mobile gait trainer that a child can use individually with minimal difficulty.

BRIEF SUMMARY

Among other things, embodiments include a gait trainer with a light-weight structure that improves the posture of a user and allows for increased maneuverability. For example, some embodiments include a light-weight body, an upper attachment portion, a cushion (e.g., a removable cushion, such as a yoga mat, or a cushion that is integrated with the light-weight body) that a user leans on and which is attached to the upper attachment portion, a plurality of mobility structures (e.g., wheels), a handle, a plurality of flexible pivot portions attached proximate to the plurality of mobility structures, a push-button joint that, when depressed, allows the gait trainer to collapse into a more easily transportable shape, and a plurality of extendible arms that allows users of differing heights to comfortable utilize the gait trainer.

In one embodiment, the gait trainer may include a plurality of detachable parts so that a user can easily construct or disassemble the gait trainer. In such an embodiment, the light-weight body may comprise a plurality of hollow tubular pieces and a plurality of connector pieces. The hollow tubular pieces may attach to the connector pieces during the construction of the light-weight frame. The hollow tubular pieces may be connected to the connector pieces by frictional forces or by an adhesive, such as glue or hook-and-loop fasteners. The plurality of mobility structures may be removable wheel pieces that may include a locking mechanism to prevent the wheels from spinning while the locking mechanism is engaged. The cushion may be a removable cushion, such as a yoga mat, that can easily be replaced once the cushion becomes damaged or shows signs of wear.

In one embodiment, a gait training device may comprise a u-shaped member comprising an upper left side bar, an upper right side bar, and an upper crossbar coupling the upper left side bar and the upper right side bar, wherein a leaning cushion is disposed across the upper crossbar. The gait training device may further comprise a c-shaped member comprising a lower left side bar, a lower right side bar, and a lower crossbar coupling the left side bar and the right side bar, wherein a first ground engagement member extends from a lower portion of the crossbar, wherein the upper left side bar is coupled with the lower left side bar at a first joint, the upper right side bar is coupled with the lower right side bar at a second, and the upper crossbar is parallel to the lower crossbar. The gait training device may further comprise a left extension with one end coupled to the first joint and the other end coupled to a third ground engaging member and a right extension with one end coupled to the second joint and the other end coupled to a fourth ground engaging member. In this embodiment, the left extension and right extension may be disposed at a 90 degree angle with respect to the c-shaped member. The left extension and right extension may also be disposed at a 180 degree angle with respect to the u-shaped member. A handle may extend from the second joint, at a 90 degree angle to the u-shaped member and the right extension and at a 180 degree angle to the c-shaped member.

In an alternate embodiment, the gait trainer may be entirely integrated with no modular pieces or may include both integrated and modular portions. In such an embodiment, the light-weight frame may be manufactured from whole pieces of material and may either exist as a single, unified construction or as frame where only a few pieces are capable of being disassembled by a user. In this embodiment, the cushion may be manufactured rubber or plastic that fits over a top portion of the light-weight frame. Some components of the gait trainer may still be removable, such as a plurality of mobility structures. This embodiment may be made from aluminum or other hardy materials, which may not be easily assembled by a user, but may be manufactured and can withstand a great amount of stress.

While multiple embodiments are disclosed, other embodiments will become apparent to those skilled in the art from the following detailed description, which shows and describes illustrative embodiments. Accordingly, the drawings and detailed description are to be regarded as illustrative in nature and not restrictive.

BRIEF DESCRIPTION OF THE DRAWINGS

The accompanying figures illustrate one or more embodiments of the disclosed gait trainer and, together with the detailed description, serve to explain the aspects and implementations of the gait trainer. In the appended figures, similar components and/or features may have the same reference label. Further, various components of the same type may be distinguished by following the reference label with a second label that distinguishes among the similar components. If only the first reference label is used in the specification, the description is applicable to any one of the similar components having the same first reference label irrespective of the second reference label. Embodiments are described in conjunction with the appended figures.

Figure 1:
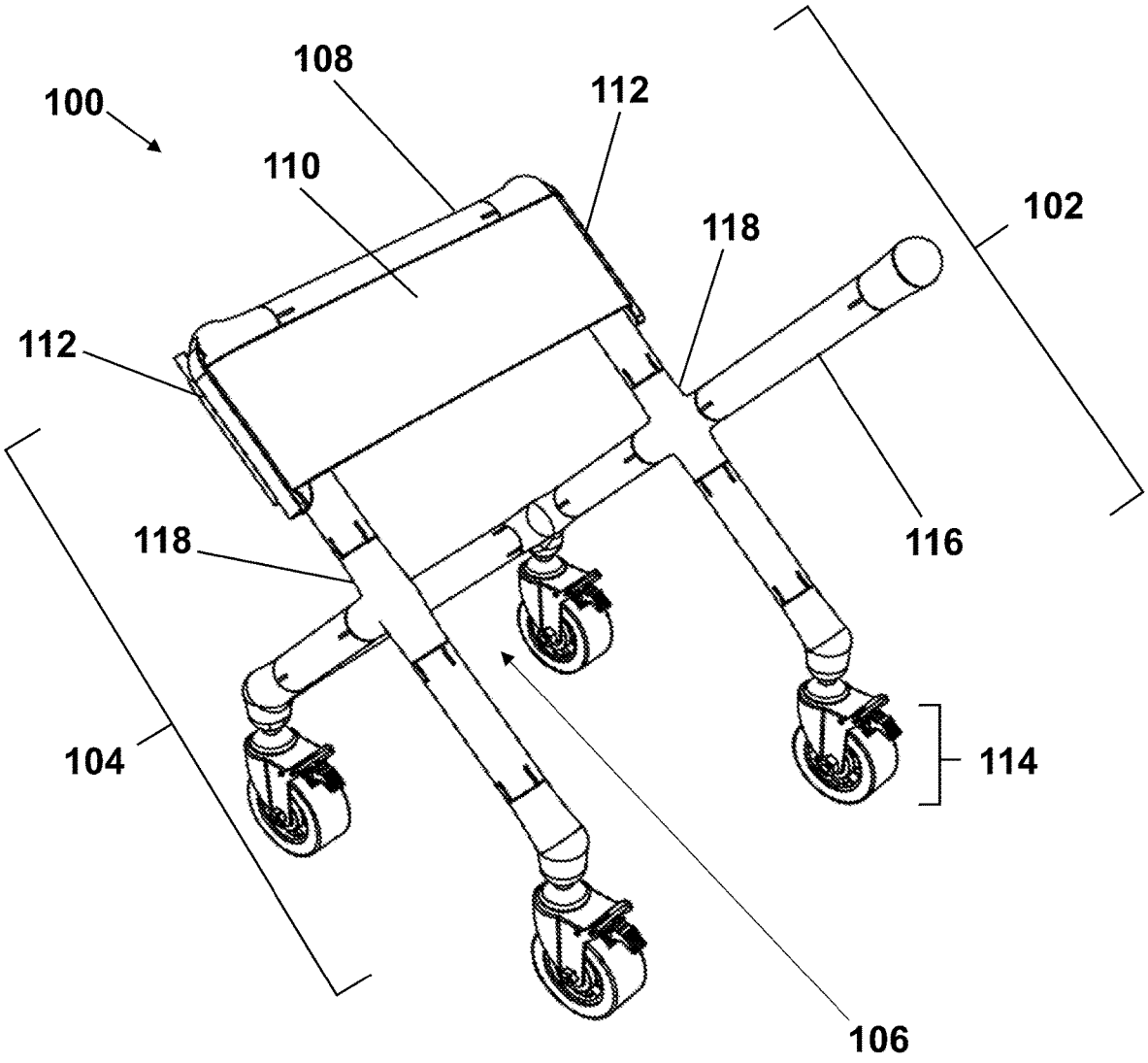
FIG. 1 shows a perspective view of an embodiment of a gait trainer.

While embodiments of the disclosure are amenable to various modifications and alternative forms, specific embodiments have been shown by way of example in the drawings and are described in detail below. The intention is not to limit the scope of the disclosure to the particular embodiments described. On the contrary, the disclosure is intended to cover all modifications, equivalents, and alternatives falling within the scope of the disclosure and the appended claims.

DETAILED DESCRIPTION

All illustrations of the drawings are for the purpose of describing selected embodiments and are not intended to limit the scope of the claims. The ensuing description provides exemplary embodiments, and is not intended to limit the scope, applicability, or configuration of the disclosure. Rather, the ensuing description of the exemplary embodiments will provide those skilled in the art with an enabling description for implementing one or more exemplary embodiments. It being understood that various changes may be made in the function and arrangement of elements without departing from the spirit and scope of the invention as set forth in the appended claims.

In one embodiment, a gait trainer 100 may be formed as a single molded piece. In such an embodiment, the gait trainer 100 may be created from any suitable material, or any combination of suitable materials, including but not limited to plastic, rubber, and/or metal. In some embodiments, the gait trainer 100 is molded, for example injection molded. In another embodiment, the gait trainer 100 is machined from various materials including, metal, plastic, rubber, wood, and/or combinations thereof. The gait trainer 100 may also be formed by three-dimensional printing, or other rapid prototyping techniques. In yet another embodiment, different portions of the gait trainer 100 are formed separately and secured together in subsequent manufacturing operations. Additionally, different portions of the gait trainer 100 can be formed from different materials. For example, the frame can be molded from PVC plastic, while the resting cushion can be formed from natural or recycled rubber.

FIG. 1 shows one embodiment of the gait trainer 100 comprising a first side frame 102, a second side frame 104, a lower c-shaped frame 106, and an upper frame 108. The upper frame 108 is connected to, and is substantially perpendicular to, the tops of both the first side frame 102 and the second side frame 104. This embodiment also comprises a leaning cushion 110, disposed proximate to the upper frame 108. Attachment portions 112 are disposed on both ends of the upper frame 108, at upper ends of the first side frame 102 and the second side frame 104, which secure end portions of the leaning cushion 110. In this embodiment, attachment portions 112 include slits that end portions of the leaning cushion 110 are inserted into, but attachment portions 112 may comprise a clamping mechanism, a cylinder that the leaning cushion 110 loops around, tape or adhesive portions, and/or any other design that can adequately and detachably secure ends of the leaning cushion 110.

In this embodiment, attachment portions 112 are disposed at an end of the first side frame 102 and the second side frame 104, but in other embodiments attachment portions 112 may be disposed at any location on the first side frame 102 and the second side frame 104. For example, attachment portions 112 may be located at any position between connector pieces 118 and an end of the frames.

In this embodiment, the first side frame 102 and the second side frame 104 are both set at a 45 degree angle with respect to the ground. In other embodiments, the first side frame 102 and the second side frame 104 may be set at any other angle. The first side frame 102 and the second side frame 104 may also be set at different angles. For example, the first side frame 102 may be set at a 30 degree angle and the second side frame 104 may be set at a 45 degree angle in one embodiment. The lower c-shaped frame 106 is connected to a middle portion of the first side frame 102 and the second side frame 104. The lower c-shaped frame 106 includes straight segments that extend perpendicularly from both the first side frame 102 and the second side frame 104 and extends towards the ground. A horizontal segment of the lower c-shaped frame 106 runs parallel to the ground and connects the straight segments. In this embodiment the lower c-shaped frame 106 comprises multiple pieces, but other embodiments consider the lower c-shaped frame 106 comprising a single piece.

Lockable wheels 114 are disposed at a lower end of the first side frame 102 and the second side frame 104 and underneath the lower c-shaped frame 106. In this embodiment there are four lockable wheels 114 arranged in a square-shaped configuration, but any number and arrangement of lockable wheels 114 may be used as long as the stability of the gait trainer 100 can be ensured. For example, there may be three lockable wheels 114 arranged in a triangle-shaped configuration with one lockable wheel 114 disposed at a middle portion of the lower c-shaped frame 106. As another example, there may be four lockable wheels 114 arranged in a non-square-shaped configuration such as a rectangle, or other four-point non-square shape. As yet another example, there may be more than four lockable wheels. Lockable wheels 114 may be set to two different operating positions. In one position, the "locked" position, the wheels are prevented from turning. In this position, a user may lean or rest on the gait trainer 100 without the gait trainer 100 moving. In the other operation position, the "unlocked" position, the wheels are free to turn. In this position, a user may use the gait trainer 100 as an ambulation aid, since the gait trainer 100 is free to move along the ground.

In an alternate embodiment, lockable wheels 114 may instead be another ground engagement member, such as a tennis ball or plastic end cap. For the purposes of this disclosure, the ground engagement member may interact with any type of natural or artificial surface, such as dirt, wood, laminate, or carpet. The specific structure of the ground engagement member may be changed by the user to best interface with a chosen surface.

The gait trainer 100 may additionally include a handle 116. Handle 116 may be provided to allow a user's support person, such as a parent, doctor, or nurse, to guide or maneuver the gait trainer 100 while in use. In this way, the handle 116 may be used as a steering device. In this embodiment, the handle 116 is disposed at a middle portion of the first side frame 102, but is not limited to this position. The handle 116 may be positioned on the second side frame, 104, the lower c-shaped frame 106, the upper frame 108, or at any other position on the gait trainer 100. Though only one handle is shown in FIG. 1, there may be multiple handles provided at any position on the gait trainer 100. In an alternate embodiment, gait trainer 100 does not include handles.

In this embodiment, the gait trainer 100 comprises modular components, as shown in FIG. 1. This arrangement allows a user to more easily construct and disassemble the gait trainer 100, as a large number of small pieces can easily be transported, e.g., to a user's home, without requiring a large amount of space. In this embodiment, the first side frame 102, the second side frame 104, and the lower c-shaped frame 106 are comprised of multiple pieces. These pieces are joined together via connector pieces 118. Connector pieces 118 comprise hollow tube-shaped protrusions and join pieces of the frame by frictional forces, or by any other means of joining the pieces together. Both connector pieces 118 and other elements of the gait trainer 100 may be comprised of plastic tubing or may be comprised of any other suitable material, such as plastics, rubbers, metals, wood, and/or the like.

The gait trainer 100, and segments of the gait trainer 100, including, but not limited to, the first side frame 102, the second side frame 104, the lower c-shaped frame 106, the upper frame 108, and the connector pieces 118, may be created from a variety of materials including, inter alia, polymer materials such as plastics, polychlorinated biphenyl piping, rubbers, metals, wood, and/or the like. In some embodiments, the first side frame 102, the second side frame 104, the lower c-shaped frame 106, and the upper frame 108 are created from a first material such as an aluminum alloy. Lockable wheels 114 may be created from materials that increase the traction or frictional engagement between the lockable wheels 114 and the ground. For example, the lockable wheels 114 may be comprised of plastic and may be coated with a material that has a higher coefficient of friction, such as rubber or another polymer compound. The use of a flexible, or semi-rigid material allows for various embodiments of the gait trainer 100 to sufficiently support a user during operation of the gait trainer 100 and may allow the user to traverse more difficult terrain. For example, a flexible frame may allow shock-absorption and may reduce increased jolts or bumps while the gait trainer 100 is in motion.

Figure 2:
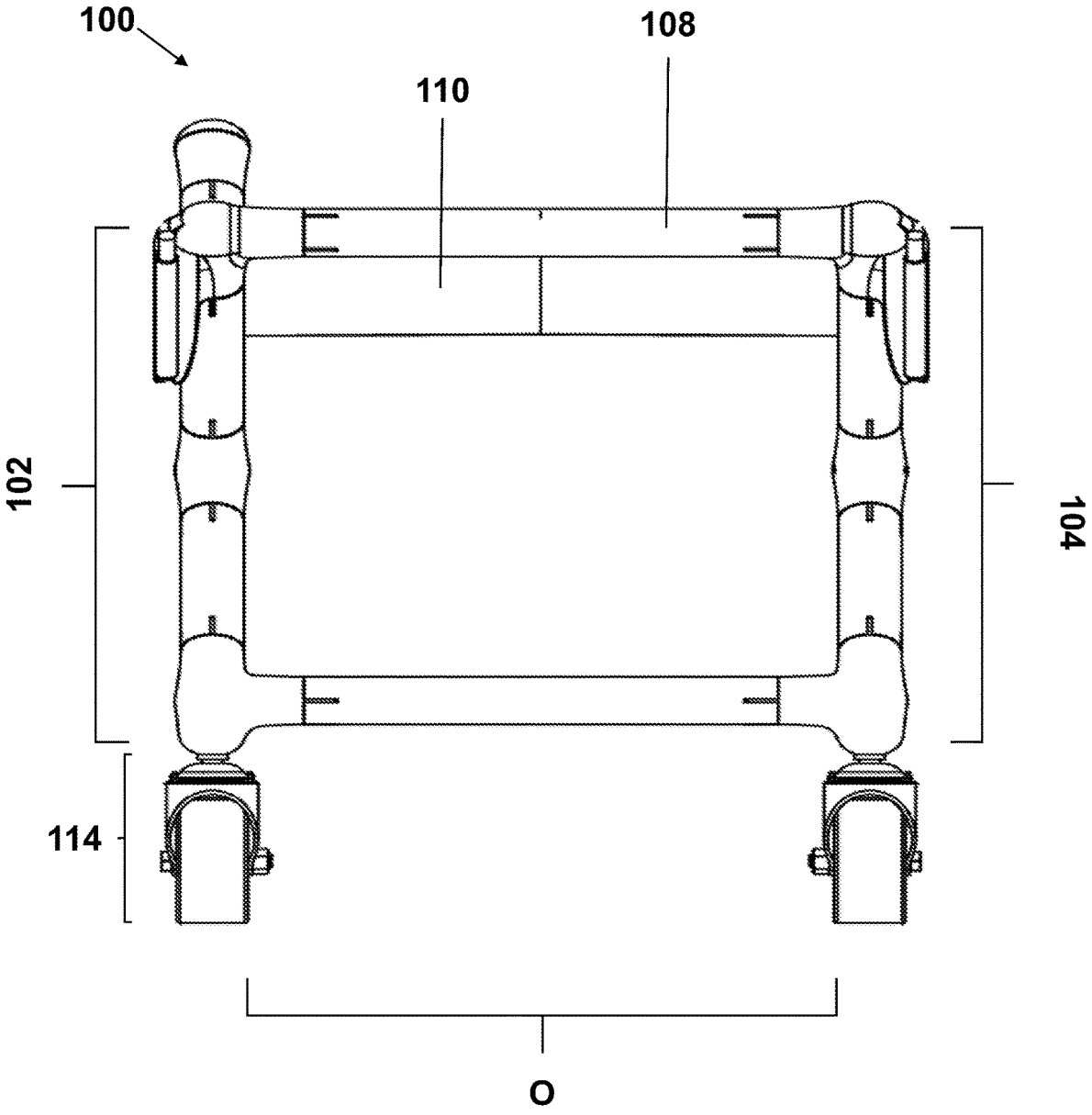
FIG. 2 shows a front view of the gait trainer of FIG. 1.

FIG. 2 illustrates a front view of the gait trainer 100. From this perspective, an operation area O can be seen in between the first side frame 102 and the second side frame 104. During operation of the gait trainer 100, a user stands within operation area O and leans against the leaning cushion 110. A view of a user 502 operating a gait trainer 500 can be seen in FIG. 5.

Since operation area O is surrounded by the first side frame 102, the second side frame 104, and the upper frame 108, a user is less likely to fall as any horizontal or forward movement is secured by the frames. In this way, a user can experience freedom of movement without the danger of falls. For additional security, lockable wheels 114 may be set to the "locked" position, preventing any forward movement.

Figure 3:
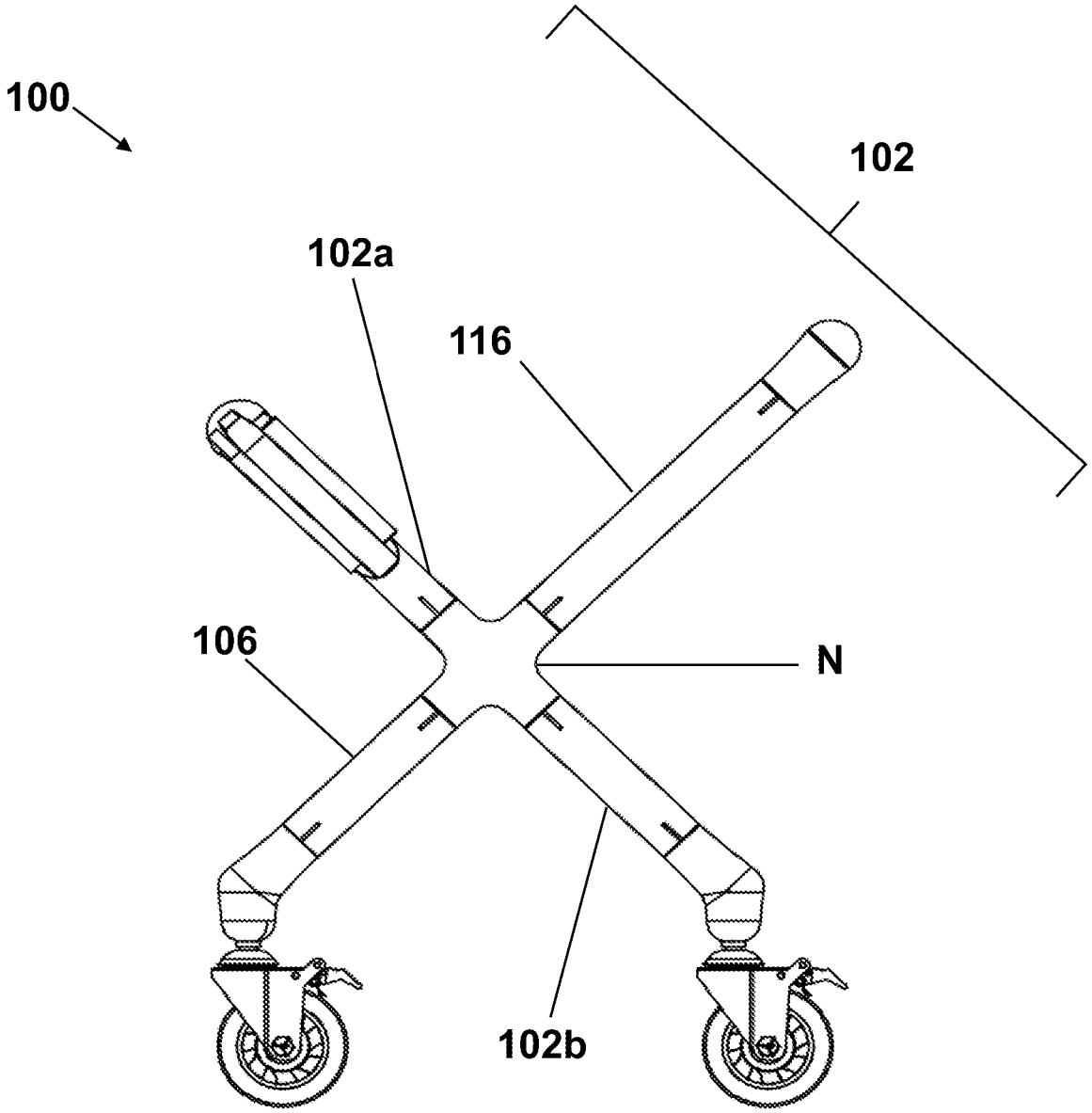
FIG. 3 shows a side view of the gait trainer of FIG. 1.

FIG. 3 illustrates a side view of the gait trainer 100. In FIG. 3, a connection nexus N connects handle 116, the lower c-shaped frame 106, and the first side frame 102 is shown. The first side frame 102 is further separated into two pieces, an upper first side frame 102*a* and a lower first side frame 102*b*.

Figure 4:
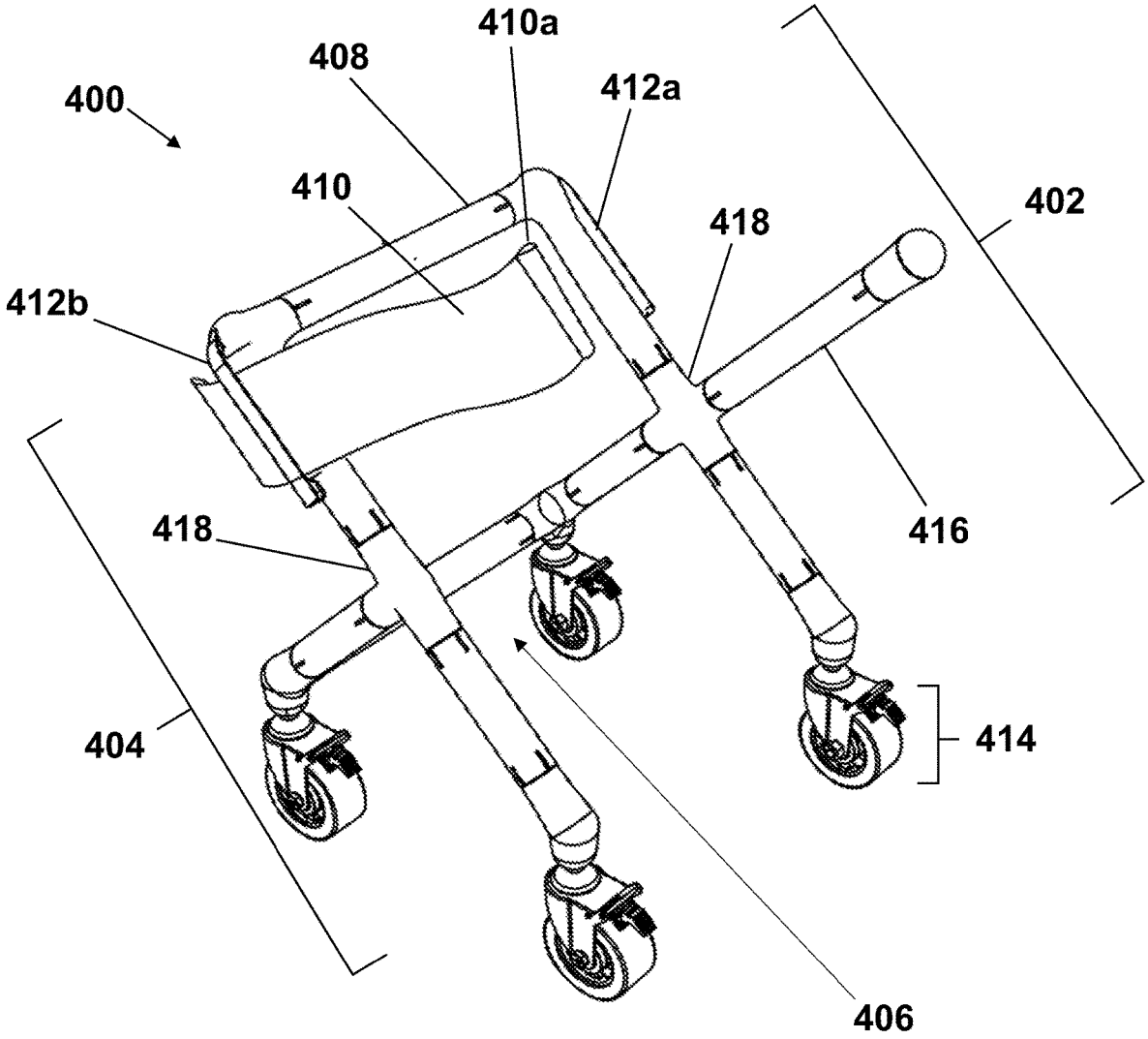
FIG. 4 shows a perspective view of the gait trainer of FIG. 1 during the installation of a leaning cushion.

FIG. 4 illustrates another embodiment of a gait trainer 400. Gait trainer 400 includes a first side frame 402, a second side frame 404, a lower c-shaped frame 406, an upper frame 408, a leaning cushion 410, a first attachment portion 412*a*, a second attachment portion 412*b*, lockable wheels 414, a handle 416, and connector pieces 418. The gait trainer 400 shown in FIG. 2 is largely identical to the gait trainer 100 shown in FIG. 1, except as described below.

In the embodiment shown in FIG. 4, the leaning cushion 410 is shown part-way through a cushion installation process. The leaning cushion 410 includes a looped portion 410*a* at one end. The looped portion 410*a* can be fed over the first attachment portion 412*a* so that the looped portion 410*a* completely surrounds the first attachment portion 412*a*. In this arrangement, the looped portion 410*a* of the leaning cushion 410 is securely attached to the first attachment portion 412*a*. In this embodiment, the second attachment portion 412*b* creates a gap between the second side frame 404. The end of the leaning cushion 410 opposite the looped portion 410*a* is fed through the gap so as to be secured by frictional and clamping forces between the second attachment portion 412*b* and the second side frame 404, or by any other means of securing the leaning cushion 410 to the looped portion 410*a*. In this manner, the leaning cushion 410 may exist in any length without resulting in wrinkles or warping when installed on the gait trainer 400.

Figure 5:
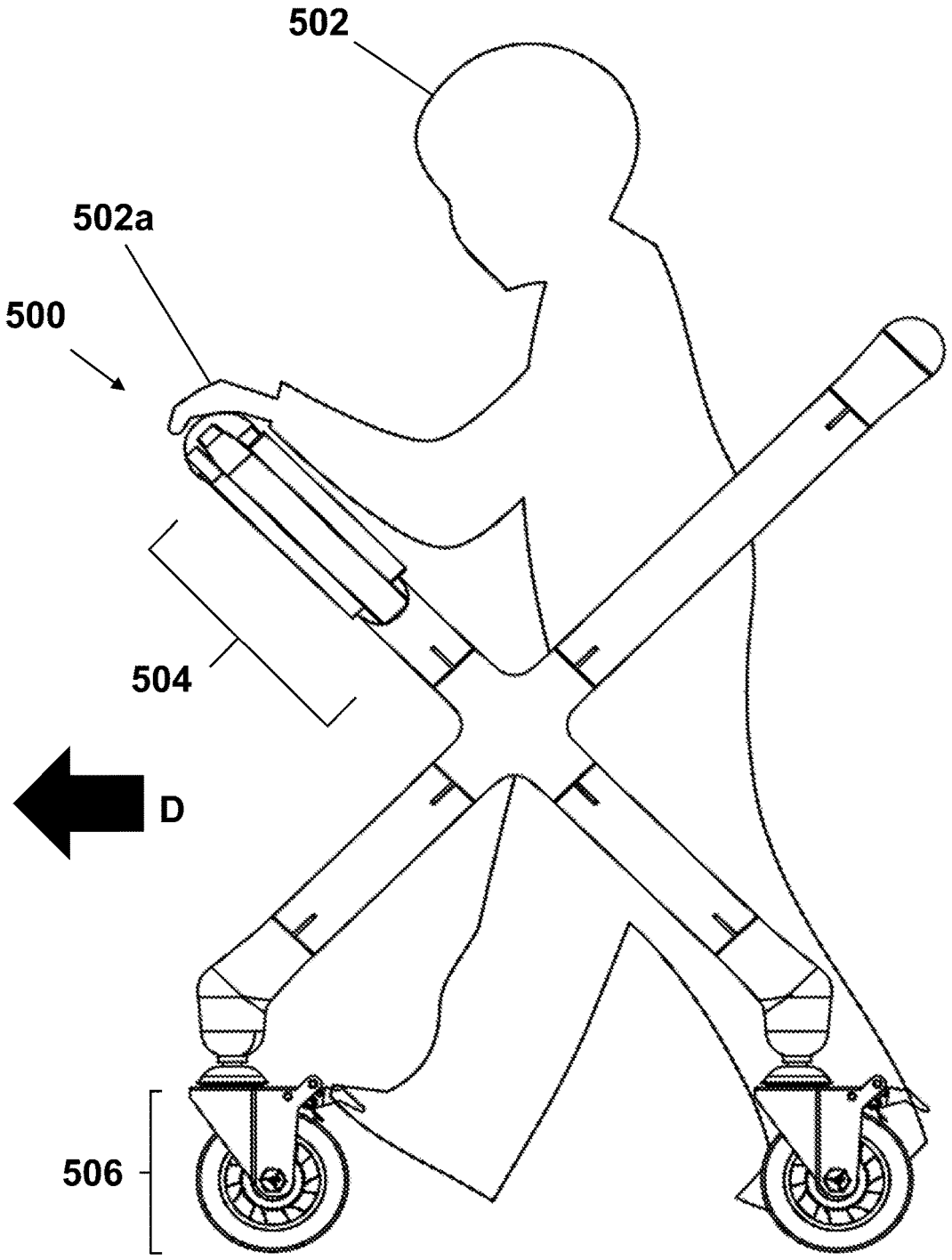
FIG. 5 shows a side view of the gait trainer of FIG. 1 while operated by a user.

FIG. 5 shows a side view of a gait trainer 500 while being operated by a user 502. This figure shows how the hands 502*a* of the user 502 rest on an upper portion 504 of the gait trainer 500 as the user 502 moves forward. As the user 502 begins to walk, the user 502 provides a force to the upper portion 504 of the gait trainer 502. This force is translated to a horizontal force and wheels 506 assist the user 502 along direction D. The gait trainer 500, therefore, prevents an unsteady user from falling, instead translating downward momentum into movement.

According to some embodiments, the gait trainer 500 may be modified, adapted, and/or customized to accommodate different sizes or strides of the user 502. For example, the size of the frame, the slope of the side frame, and/or the diameter of the wheels may need to be varied to each individual user's body type, disabilities, or preferences. Adjustments may also be made as a user ages, so that an entirely new apparatus is not needed and a currently owned apparatus may be slightly modified. It is noted that FIGS. 1-5 are not necessarily to scale and changes in size may be relative to the user, any component of the gait trainer, or absolute with respect to component dimension, structure, or both.

The components in any embodiment of the gait trainer may be hollow, solid, or any combination thereof. For example, in certain embodiments components of the frame may be hollow plastic, metal, wood, or any other suitable material. In other embodiments, components of the frame may be solid plastic, metal, wood, or any other suitable material.

While a number of aspects and embodiments have been discussed above, persons having ordinary skill in the art will recognize certain modifications, permutations, additions, and equivalents may alternatively be used or introduced. It is intended that the scope of the following claims be interpreted to include all such modifications, permutations, additions, and equivalents. The terms and expressions used herein are for description, not limitation, and there is no intention to exclude any equivalents of the aspects shown and described.

In addition, any workable combination of the features and elements disclosed herein can be employed.

Having described several embodiments, it will be recognized by those of skill in the art that various modifications, alternative constructions, and equivalents may be used without departing from the spirit of the disclosure. Additionally, a number of well-known processes and elements have not been described in order to avoid unnecessarily obscuring the present disclosure. Accordingly, the above description should not be taken as limiting the scope of the disclosure.

What is claimed is:

1. A gait training device for use in assisting a user with mobility, comprising:

a first side frame disposed diagonally relative to a ground surface and including a first cushion attachment disposed at an end of the first side frame;

a second side frame parallel to the first side frame and including a second cushion attachment disposed at an end of the second side frame;

a leaning cushion detachably secured to the first cushion attachment and the second cushion attachment, the leaning cushion comprising a flexible sheet and configured to support a user's weight applied while the user is in a standing position;

a first joint disposed at a middle portion of the first side frame;

a second joint disposed at a middle portion of the second side frame; and a lower c-shaped frame extending perpendicularly from both the first joint and the second joint, wherein the first side frame, the second side frame, and the lower c-shaped frame define an operation area and are configured to accommodate the user.

2. The gait training device of claim 1, further comprising a first ground engagement member disposed at a bottom end of the first side frame and a second ground engagement member disposed at a bottom end of the second side frame.

3. The gait training device of claim 2, wherein the lower c-shaped frame further comprises a bottom crossbar disposed perpendicular relative to the first side frame and to the second side frame.

4. The gait training device of claim 3, further comprising a third ground engagement member and a fourth ground engagement member, the third and fourth ground engagement members connected to the bottom crossbar, wherein the first ground engagement member and the second ground engagement member are located at a back of the operation area and the third ground engagement member and the fourth ground engagement member are located at a front of the operation area.

5. The gait training device of claim 4, wherein the third ground engagement member comprises a first wheel element, and the fourth ground engagement member comprises a second wheel element.

6. The gait training device of claim 1, further comprising a mobility handle extending from the second side frame.

7. The gait training device of claim 1, wherein the first side frame comprises at least a top segment and a bottom segment and the second side frame comprises a top segment and a bottom segment.

8. The gait training device of claim 1, wherein the first cushion attachment includes a slit configured to receive a portion of the leaning cushion.

9. A gait training device for use in assisting a user with mobility, comprising:

a first side frame;

a second side frame parallel to the first side frame;

the first and second side frames configured for placement upon an underlying flat surface, the first and second side frames together, when placed upon the underlying flat surface, have four contact points with the underlying flat surface, wherein the first side frame has two of the four contact points with the underlying flat surface, and the second side frame has two of the four contact points with the underlying flat surface;

a leaning portion substantially perpendicular to the first side frame and to the second side frame, the leaning portion comprising a flexible sheet and connecting an upper portion of the first side frame to an upper portion of the second side frame; and a lower support portion that connects the first side frame to the second side frame such that the lower support portion is positioned vertically below the leaning portion, wherein the first side frame and the second side frame are configured to detach from the lower support portion.

10. The gait training device of claim 9, wherein the leaning portion is attached to the first side frame with a first connection element and the second side frame with a second connection element.

11. The gait training device of claim 9, wherein the leaning portion comprises a removable cushioned material.

12. The gait training device of claim 9, wherein at least one of the four contact points comprises a detachable wheel.

13. The gait training device of claim 9, wherein the first side frame comprises at least two detachable pieces and the second side frame comprises at least two detachable pieces.

14. The gait training device of claim 9, further comprising an elongated handle extending from the second side frame.

15. The gait training device of claim 9, wherein the first side frame further comprises a first extension that extends from a center portion of the first side frame, the second side frame further comprises a second extension that extends from a center portion of the second side frame, and the lower support portion connects, and is perpendicular to, the first extension and the second extension.

16. The gait training device of claim 9, at least partially comprised of polyvinyl chloride plastic.

* * * * *